US009441399B2

(12) United States Patent
Yu

(10) Patent No.: US 9,441,399 B2
(45) Date of Patent: Sep. 13, 2016

(54) LOCK

(71) Applicant: Chun Te Yu, Changhua County (TW)

(72) Inventor: Chun Te Yu, Changhua County (TW)

( * ) Notice: Subject to any disclaimer, the term of this patent is extended or adjusted under 35 U.S.C. 154(b) by 101 days.

(21) Appl. No.: 13/969,229

(22) Filed: Aug. 16, 2013

(65) Prior Publication Data

US 2014/0047873 A1 Feb. 20, 2014

(30) Foreign Application Priority Data

Aug. 17, 2012 (TW) ..... 101129971 A

(51) Int. Cl.

| | |
|---|---|
| ***E05B 67/08*** | (2006.01) |
| ***E05B 37/00*** | (2006.01) |
| ***E05B 41/00*** | (2006.01) |
| ***E05B 35/10*** | (2006.01) |
| ***E05B 37/02*** | (2006.01) |
| ***E05B 39/00*** | (2006.01) |
| *E05B 29/00* | (2006.01) |

(52) U.S. Cl.

CPC ..... *E05B 37/0034* (2013.01); *E05B 35/105* (2013.01); *E05B 37/0031* (2013.01); *E05B 37/025* (2013.01); *E05B 39/00* (2013.01); *E05B 41/00* (2013.01); *E05B 29/00* (2013.01); *Y10T 70/465* (2015.04); *Y10T 70/7486* (2015.04)

(58) Field of Classification Search

CPC ..... Y10T 70/7141; Y10T 70/7147; Y10T 70/415; Y10T 70/80; Y10T 70/8108; Y10T 70/8162; Y10T 70/8189; E05B 17/145; E05B 37/0031; E05B 17/0034; E05B 41/00

USPC ..... 70/21, 284, 285, 432–441

See application file for complete search history.

(56) References Cited

U.S. PATENT DOCUMENTS

| | | | | |
|---|---|---|---|---|
| 7,357,007 | B2 * | 4/2008 | Lin | 70/21 |
| 7,628,045 | B2 * | 12/2009 | Yu | E05B 37/025 70/21 |
| 7,770,421 | B2 * | 8/2010 | Yu | 70/21 |
| 7,779,657 | B2 * | 8/2010 | Yu | E05B 37/0034 70/21 |
| 7,832,238 | B2 * | 11/2010 | Misner et al. | 70/21 |
| 8,056,376 | B2 * | 11/2011 | Yu | 70/21 |
| 8,171,760 | B2 * | 5/2012 | Yen et al. | 70/21 |
| 8,353,184 | B2 * | 1/2013 | Ling | E05B 35/105 70/21 |
| 2005/0262902 | A1 * | 12/2005 | Ling | E05B 37/0034 70/21 |
| 2006/0266084 | A1 * | 11/2006 | Kuo et al. | 70/21 |
| 2008/0156046 | A1 * | 7/2008 | Yu | E05B 37/0034 70/21 |
| 2009/0031764 | A1 * | 2/2009 | Huang | E05B 37/0034 70/21 |
| 2011/0289988 | A1 * | 12/2011 | Yu | 70/284 |
| 2014/0352370 | A1 * | 12/2014 | Huang | E05B 37/0034 70/21 |

FOREIGN PATENT DOCUMENTS

| | | |
|---|---|---|
| TW | 200925373 | 6/2009 |
| TW | I333017 | 11/2010 |

* cited by examiner

*Primary Examiner* — Christopher Boswell

(74) *Attorney, Agent, or Firm* — Muncy, Geissler, Olds & Lowe, P.C.

(57) ABSTRACT

A lock comprises a lock casing, a shackle, an indicating device and a button component. The shackle is movably disposed on the lock casing. The indicating device is disposed in the lock casing, and moves from one original position to an indicating position with respect to the lock casing. The button component connects to the indicating device for restricting the movement of the shackle, the button component moves from a first position to a second position, for enabling the indicating device to move from the indicating position back to the original position.

10 Claims, 16 Drawing Sheets

1 ||

C-C cross-section

A-A cross-section

C-C cross-section

A-A cross-section

C–C cross-section

A–A cross-section

A-A cross-section

A-A cross-section

B-B cross-section

B-B cross-section

LOCK

BACKGROUND OF INVENTION

1. Field of Invention

The present invention relates to a lock, in particular, relates to a padlock having a button component and an indicating device, and the button component is used for restricting the movement of a shackle of a padlock and resetting the indicating device.

2. Related Prior Art

Traditionally, a padlock having an indicating device padlock is mainly used for locking luggage. During custom checking, Customs officers unlocked the padlock and performed security check on the luggage via a specific key without breaking the padlock. Accordingly, users become aware if the padlock was unlocked and the luggage was examined via the indicating device of the padlock.

The published patent application Taiwan Publication No. 200925373 discloses a lock having an indicatory lock core, which comprises a lock casing, a shackle, an indicating lock core and a number lock core disposed in the lock casing for locking and unlocking respectively, and a resetting plate disposed in the lock casing and connects to the indicating lock core. The indicating lock core is a key lock core, which moves from an original position to an indicating position when operated by a corresponding key. When the indicating lock core is at the indicating position, a part of the indicating lock core is situated outside the lock casing, and when the indicating lock core is at the indicating position, the indicating lock core is restored to the original position via pushing the resetting plate with a tool.

The patent Taiwan patent No. I333017 discloses a padlock, having a lock casing, a shackle, a barrier component disposed at the exterior of the lock casing, a key lock core and a number lock core disposed in the lock casing for locking and unlocking respectively, an indicator disposed in the barrier component. The barrier component is used for restricting the free segment of the shackle, and connecting to the key lock core, and rotates as the key lock core rotates, for releasing or restricting the free segment of the shackle which is used for locking and unlocking purposes. The indicator is used for indicating if the key lock core has been unlocked.

SUMMARY OF INVENTION

The present invention provides a lock comprising a lock casing and a key lock core. The key lock core has a spindle. The spindle has a key hole for receiving a matching key. Wherein, the spindle is able to move from an original position to an indicating position and the spindle is able to be rotated by the key at the original position or the indicating position.

The present invention also provides a lock comprising a lock casing, a shackle, a key lock core and a button component. The shackle comprises a root segment which is disposed in the lock casing and rotatable and a free segment which extends from the root segment. The key lock core is disposed in the lock casing and has a spindle. Wherein, the spindle has a key hole for receiving a matching key and the spindle is able to move from an original position to an indicating position. The button component connects to the spindle and is located on a position which blocks the free segment of the shackle. Wherein, the button component drives the spindle to move from the indicating position to the original position. The lock preferably further has a connecting component. The connecting component has one end located in a slot of the button component and the other end connecting to the key lock core. Wherein, when the spindle is at the original position, the end of the connecting component is at a distance from a bottom edge of the slot whereby the spindle stays at the original position upon the button component is pulled, and the end of the connecting component contacts the bottom edge of the slot when the spindle is at the indicating position whereby the spindle immediately moves from the indicating position to the original position upon the button component is pulled.

Preferably, the spindle moves from the original position to the indicating position upon the spindle is operated by the key. Preferably, the spindle moves from the original position to the indicating position upon the key is pulled out of the key hole.

Preferably, the lock casing has a hole, the spindle is located within the key casing completely when the spindle is at the original position, and the spindle partly extrudes outside of the lock casing from the hole when the spindle is at the indicating position.

The present invention also provides a lock, having a shackle, a button component for controlling the shackle rotation, and an indicating device moving between an original position and an indicating position, wherein, the button component is configured for driving the indicating device on the indicating position to move back to the original position. Preferably, the indicating device linearly moves from the original position to the indicating position along a first direction, the button component linearly moves along a second direction and drives the indicating device moving from the indicating position to the original position, wherein the first direction opposites the second direction. Preferably, the indicating device is a spindle and the spindle has a key hole for receiving a key.

Further benefits and advantages of the present invention will become apparent after a careful study of the detailed description with reference to the accompanying drawings.

DETAILED DESCRIPTION OF EMBODIMENTS

Figure 1:
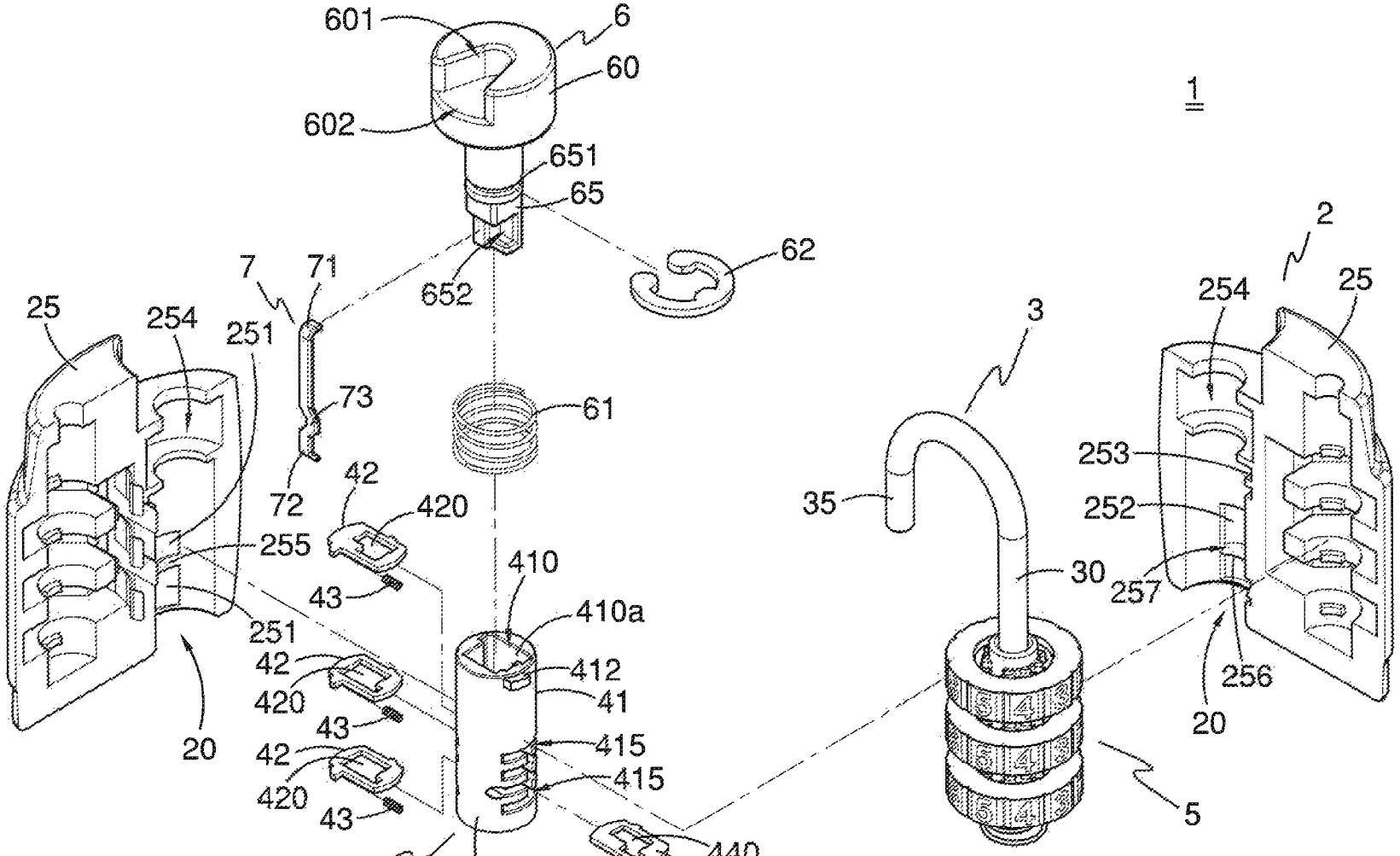
FIG. 1 is an exploded diagram according to a preferred embodiment of the present invention.
Figure 2:
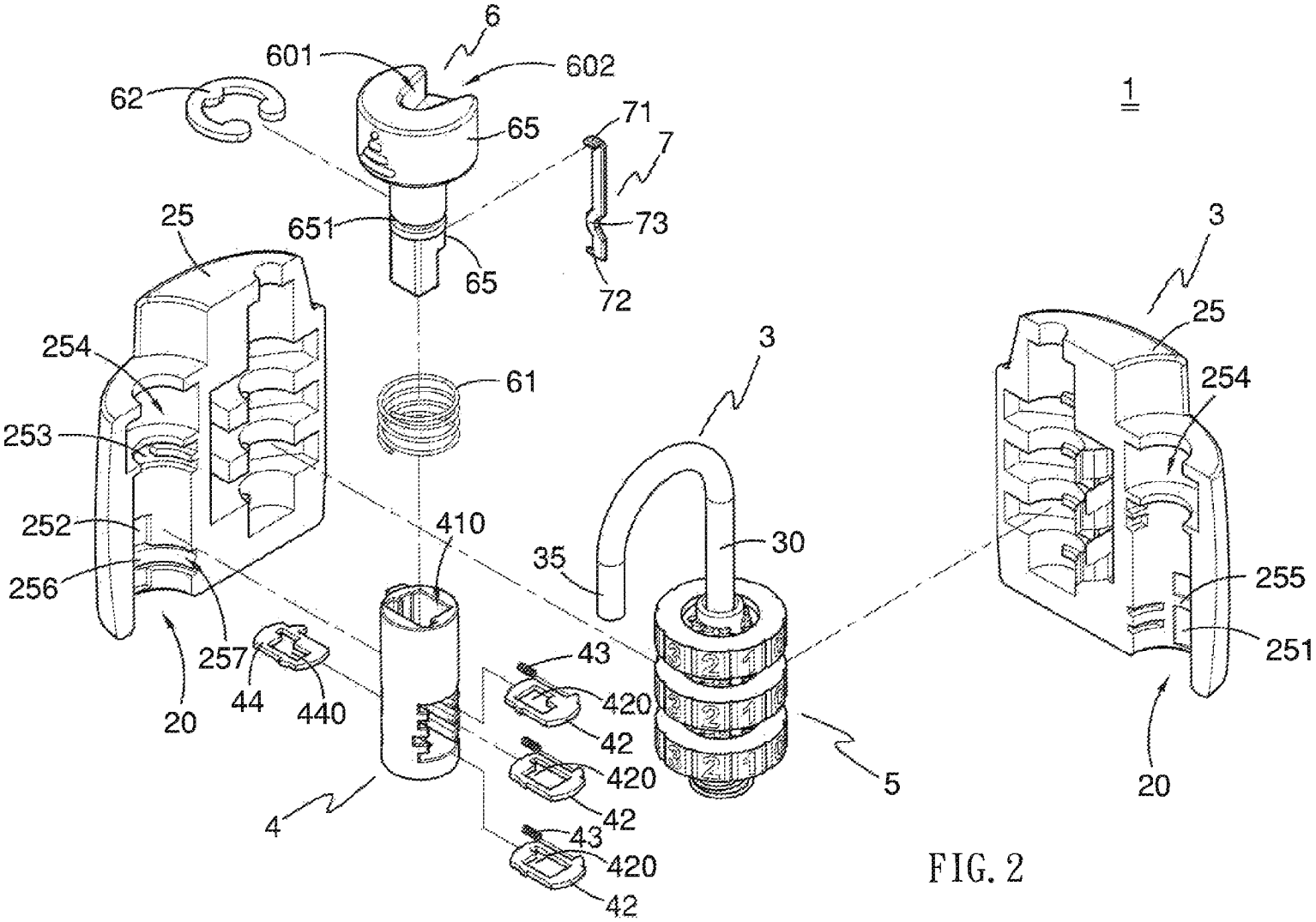
FIG. 2 is the other exploded diagram according to the preferred embodiment of the present invention.
Figure 3:
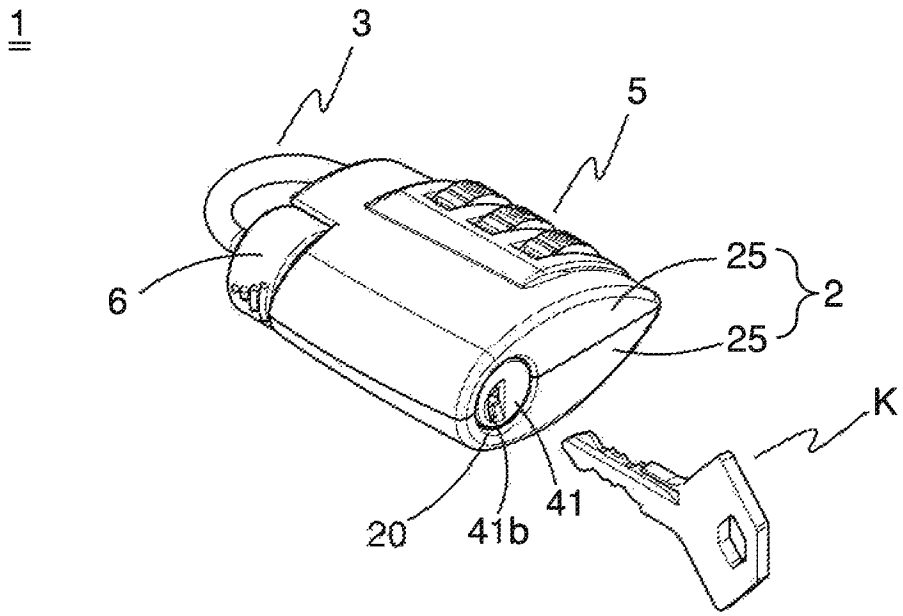
FIG. 3 is a three dimensional diagram according to the preferred embodiment.

FIGS. 1, 2 and 3 are exploded diagrams and a three dimensional diagram of the lock according to a preferred embodiment of the present invention, wherein a padlock 1 is used as an example. The padlock 1 comprises a lock casing 2, a shackle 3, a key lock core 4 and number lock 5 for locking and unlocking and a button component 6. The lock casing 2 comprises two doubling casing body 25, a pore 20 is disposed in the bottom of the lock casing 2 and connects to the outside of the lock casing 2. The shackle 3 comprises a root segment 30 and a free segment 35. The root segment 30 is disposed in the lock casing 2. The free segment 35 extends from the root segment 30 and is located outside the lock casing 2. The free segment 35 rotates with respect to the root segment 30. The key lock core 4 is disposed in the lock casing 2. The number lock 5 is disposed in the lock casing 2, and connects to the root segment 30 of the shackle 3, for restricting or releasing the root segment 30 of the shackle 3. The button component 6 comprises a head component 60 and extends from an extending component 65 of the head component 60. The head component 60 is situated outside the lock casing 2, for restricting or releasing the free segment 35 of the shackle 3. The extending component 65 extends into the lock casing 2 and connects to the key lock core 4. The button component 6 further comprises a connecting component 7 disposed in the lock casing 2 having two ends respectively connect to the extending component 65 and the key lock core 4.

Preferably, the head component 60 of the button component 6 has a receiving channel 601. The free segment 35 of the shackle 3 extends into the receiving channel 601 and the periphery of the receiving channel 601 has a gap 602.

Figure 5:
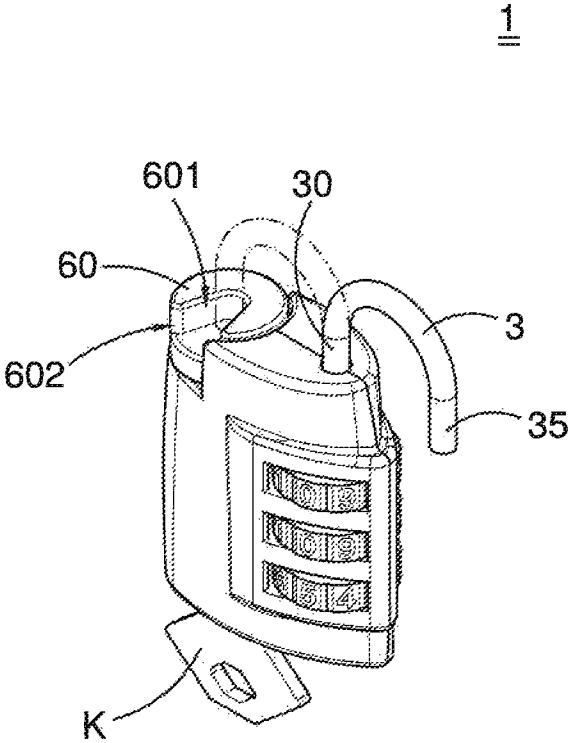
FIG. 4 and FIG. 5 illustrate the key lock core moves from a locked status to an unlocked status according to the preferred embodiment.
Figure 4:
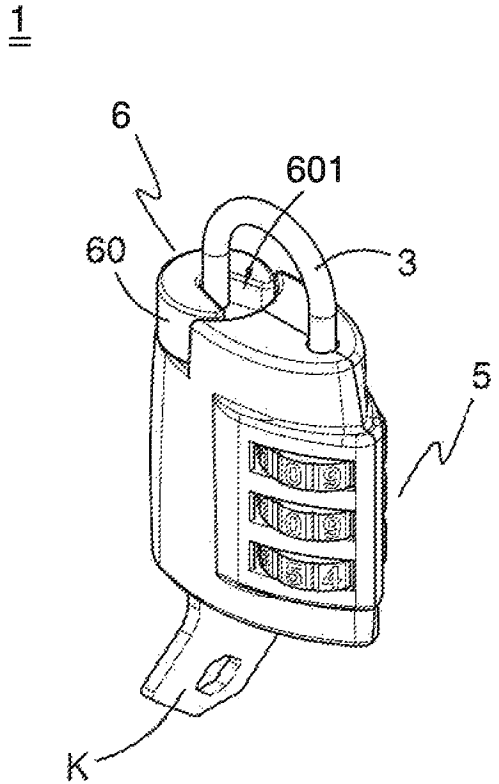
Figure 7:
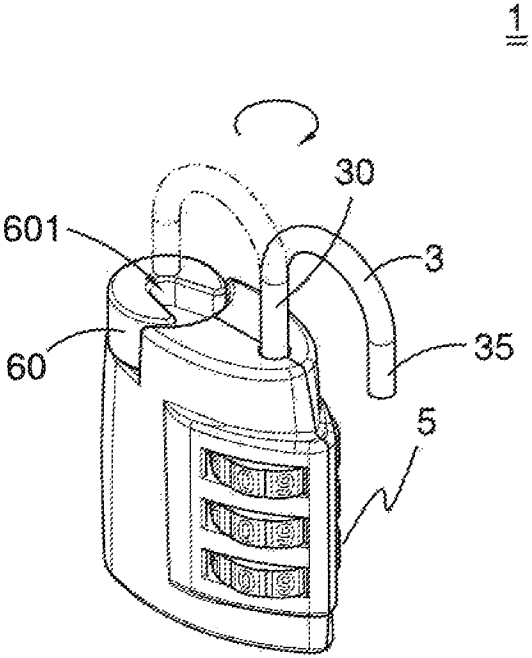
FIG. 6 and FIG. 7 illustrate the number lock at an unlocked status according to the preferred embodiment.
Figure 6:
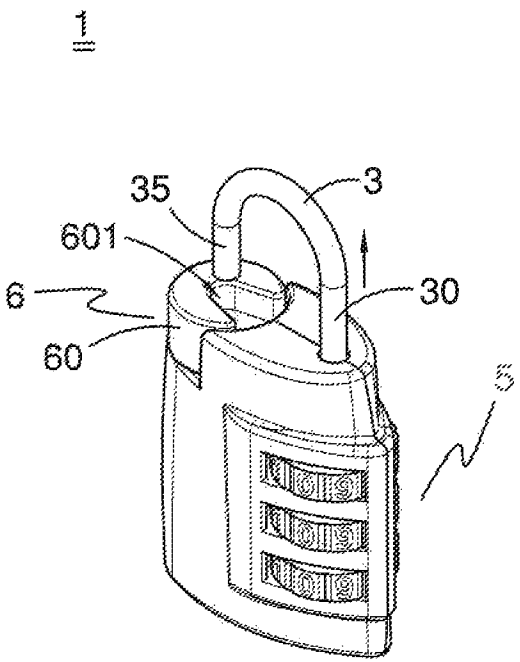
Figure 8:
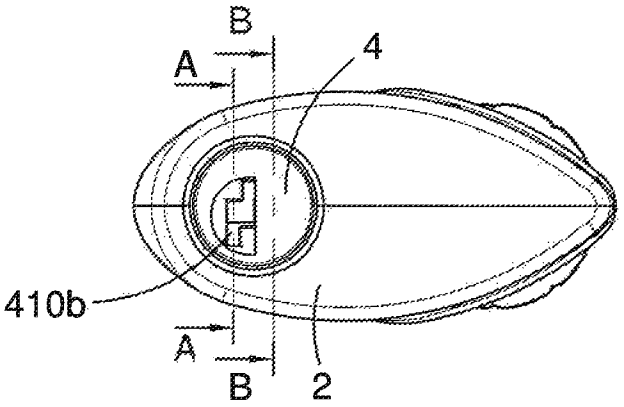
FIG. 8 illustrates a bottom view of the preferred embodiment.

Refer to FIG. 3, FIG. 4 and FIG. 5, the padlock 1 rotates the key lock core 4 via a key K, and driving the button component 6 to move from a restrict position (FIG. 4) to a release position (FIG. 5). When the button component 6 is located at the release position, the free segment 35 of the shackle 3 rotates with respect to the root segment 30, and moves away from the receiving channel 601 of the head component 60 to the outside of the head component 60 via the gap 602, which transfers the padlock 1 to an unlocked status. In addition, as shown in the FIG. 4, FIG. 6 and FIG. 7, the padlock releases the root segment 30 of the shackle 3 after the number lock 5 is dialed a set of correct number, the shackle 3 is enabled to move up/down with respect to the casing body 2 (FIG. 4 and FIG. 6), lifts the free segment 35 to move away from the receiving channel 601 of the head component 60 and rotates with respect to the root segment 30, which transfers the padlock 1 to an unlocked status, as shown in FIG. 7. When the shackle 3 is operated, the free segment 35 moves back to the receiving channel 601, by rotating the key K counter clockwise, the lock core 4 is driven to rotate counter clockwise and the button component 6 is driven to move from the release position to the restrict position which transfers the padlock 1 to a locked status.

Figure 9A:
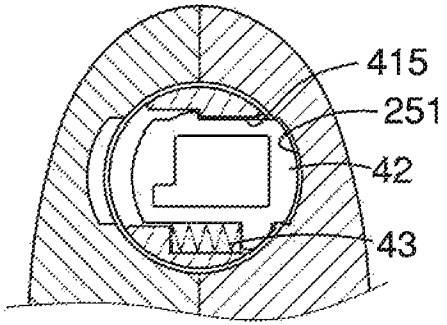
FIG. 9A is a C-C cross-section diagram of FIG. 9.
Figure 9B:
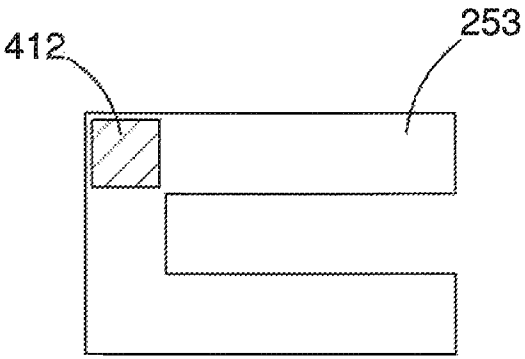
FIG. 9B is a position schematic diagram illustrating the bump of the spindle located at a channel of the lock casing in the FIG. 9.
Figure 9:
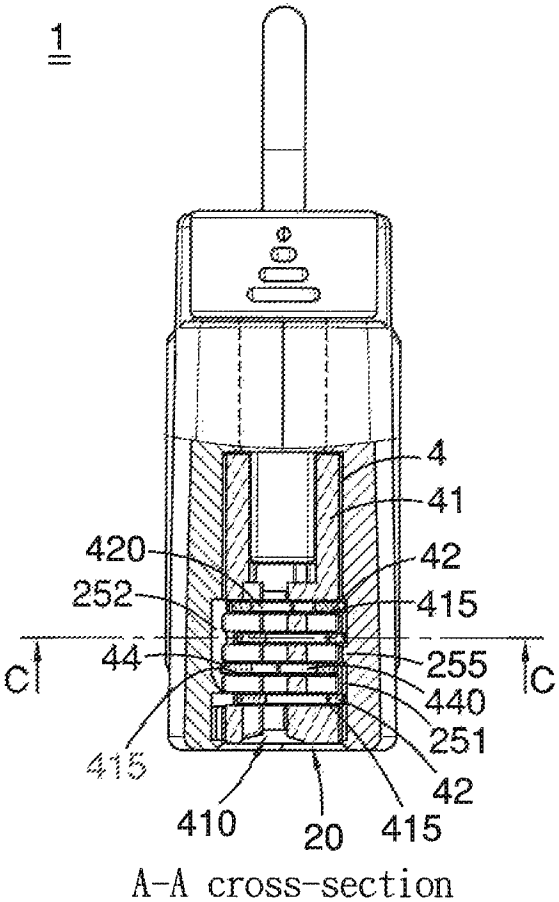
FIG. 9 illustrates a partial cross-section diagram of the preferred embodiment.
Figure 10A:
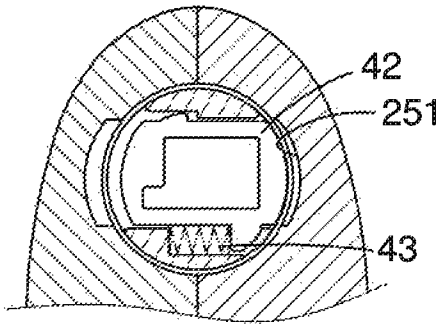
FIG. 10A is a C-C the partial cross-section diagram.
Figure 10B:
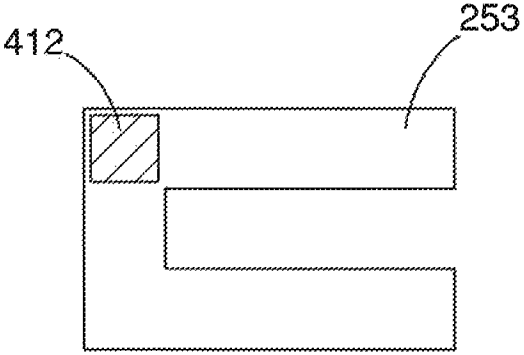
FIG. 10B is a position schematic diagram illustrating the bump of the spindle located on the channel.
Figure 10:
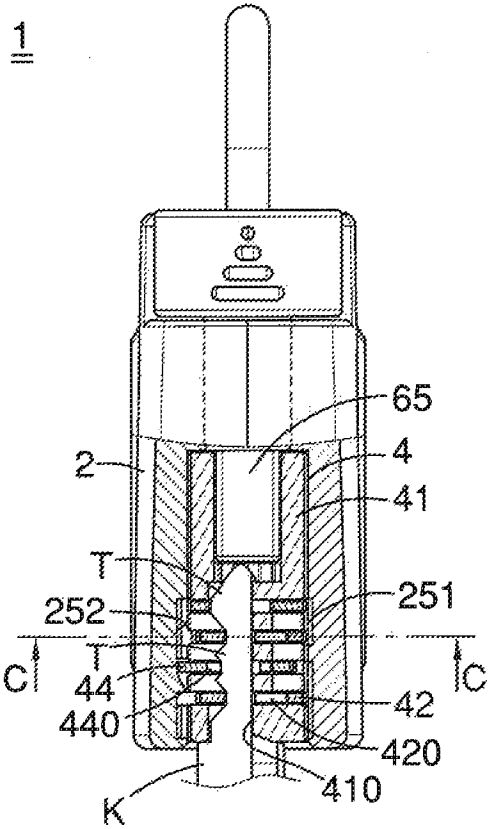
FIG. 10 is a partial cross-section diagram illustrating the key injecting into the spindle of the key lock core according to the preferred embodiment.

As shown in FIG. 1, FIG. 2 and FIG. 9, the key lock core 4 comprises a spindle 41, a plurality of strips 42, a plurality of springs 43 corresponding to the strips 42, and a barrier plate 44. The exterior wall of the spindle 41 further has bump 412. The spindle 41 further has a vertical pathway 410 and several horizontal pathways 415 parallel to each other. The horizontal pathways 415 are perpendicular and connect to the vertical pathway 410. One end of the vertical pathway 410 forms a receiving opening 410*a* located on the top side of the spindle 41, and the other end forms a key hole 410*b* located on the bottom side of the spindle 41. The receiving opening 410*a* receives the extending component 65. The key hole 410*b* receives the key K. The extending component 65 is not circular and is approximately rectangular. The receiving opening 410*a* is approximately rectangular and extends for a distance towards the inner part of the spindle 41 along the vertical pathway 410. In short, the shape of the extending component 65 matches the shape of the receiving opening 410*a* and the extending component 65 and the receiving opening 410*a* are engaged with each other, whereby the component 6 rotates upon the spindle 41 is rotated. The strips 42, the springs 43 and the barrier plate 44 of the key lock core 4 are respectively disposed in the horizontal pathways 415. The strips 42 and the corresponding springs 43 are one on one respectively disposed in the corresponding horizontal pathways 415. The strips 42 are impacted by the springs 43, the edges extend in the same direction towards the outside of the corresponding horizontal pathway 415 (FIG. 9 and FIG. 9A). Each strip 42 has a through hole 420, and the through hole 420 faces and connects to a vertical pathway 410 of the spindle 41. The barrier plate 44 also has a through hole 440. The through hole 440 faces and connects to the vertical pathway 410 of the spindle 41 (FIG. 9). The key K is inserted into the spindle 41 from the key hole 410*b* of the vertical pathway 410 and goes through the strips 42 and the through holes 420, 440 of the barrier plate 44 located within the spindle 41 (FIG. 10).

On the other hand, as shown in the FIG. 1 and FIG. 2, the lock casing 2 has a first groove 251, a second groove 252 located opposite the first groove 251 and a channel 253. The edges extend outside the spindle 41 of the strips 42 of the key lock core 4 and are located in the first groove 251 (FIG. 9A). The position of the second groove 252 approximately corresponds to the position of the barrier plate 44 located in the spindle 41, and is located opposite the first groove 251 (FIG. 9). The channel 253 corresponds to the position of the bump 412 of the spindle 41. The bump 412 is located in the channel 253, and moves within the channel 253. The first groove 251 has a first rib 255 extending from the interior wall for blocking the corresponding strip 42 located in the first groove 251 under specific scenarios, which is detailed in the following. The second groove 252 has a second rib 256 extending from the interior wall. The second rib 256 has an incline 257, for leading or blocking the barrier plate 44 under specific scenarios, which is detailed in the following.

FIG. 9 to FIG. 14 are diagrams illustrating that the key lock core 4 is implemented as an indicating device for indicating if the padlock 1 has been operated by the key K.

FIG. 9 illustrates a partial cross-section diagram of the preferred embodiment before the padlock 1 is inserted by the key K while the padlock 1 is at a locked position. Each strip 42 of the key lock core 4 is pushed by the elastic force generated by the corresponding spring 43 and partly extends into the first groove 251. As shown in the FIG. 9A, the key lock core 4 is restricted by the opposite walls of the first groove 251 and is not able to rotate. Also, because one of the strip 42 blocking the upper side of the first rib 255, the key lock core 4 is not able to move towards the pore 20 at the bottom of the lock casing 2. Also, FIG. 9B is a position diagram illustrating the bump 412 of the spindle 41 located in the channel 253 before the key K is inserted into the padlock 1.

FIG. 10 is a partial cross-section diagram after the key lock core 4 of the padlock 1 is inserted by the key K. The key K is inserted in to the vertical pathway 410 of the spindle 41 of the key lock core 4 through the through holes 420, 440 of the strips 42 and the barrier plate 44 respectively. At the time, several teeth T of the key K push the pore wall of the through holes 420, 440 respectively, the strips 42 accordingly retract from the first groove 251 to the corresponding horizontal pathway 415 in the spindle 41. As shown in the FIG. 10A, the springs 43 corresponding to the strips 42 generate elastic force in the process. At the time, the barrier plate 44 is pushed by the teeth T as the key K inserting into the spindle 41, and partly extends outside the horizontal pathway 415 of the spindle 41 into the second groove 252 of the lock casing 2. Also, FIG. 10B is a position diagram illustrating the bump 412 of the spindle 41 located in the channel 253 when the key K is inserted into the padlock 1.

Figure 11A:
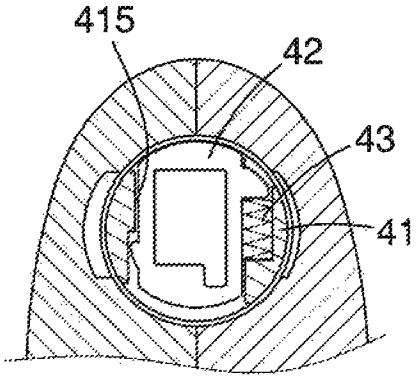
FIG. 11A is a C-C cross-section diagram of FIG. 11.
Figure 11B:
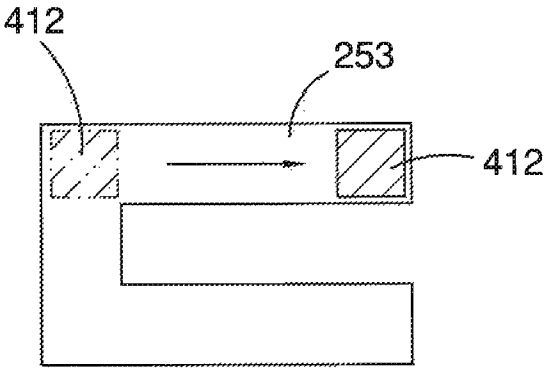
FIG. 11B is a moving position schematic diagram illustrating the movement of the bump of the spindle in the channel in the FIG. 11.
Figure 11:
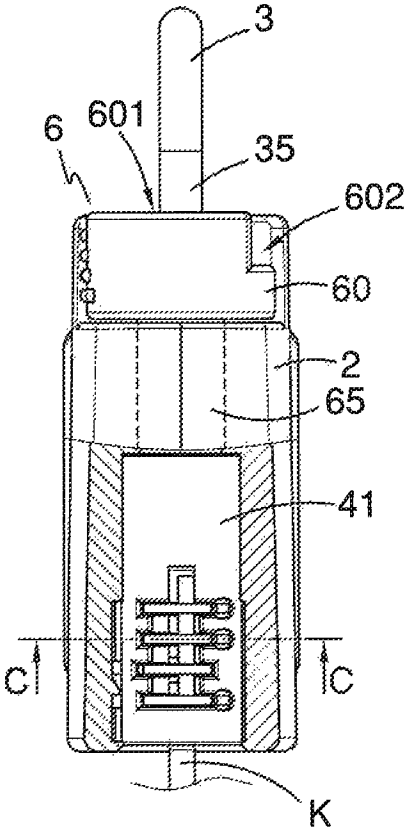
FIG. 11 is a partial cross-section diagram of the spindle of the key lock core illustrating the key injecting into the spindle and turning to the unlocked status according to the preferred embodiment.

FIG. 11 illustrates that the key lock core 4 of the padlock 1 is rotated by the key K, and the padlock 1 is at the unlocked status. The spindle 41 is rotated to the position shown in the FIG. 11A. The strips 42 are continuously pushed by the teeth T of the key K and retract to the corresponding horizontal pathway 415. The springs 43 is kept at a compressed status. At the same time, the button component 6 is driven by the spindle 41 to the release position, such that the free segment 35 of the shackle 3 rotates away from the head component 60 of the button component 6 (FIG. 5). Also, the bump 412 of the spindle 41 moves in the channel 253 to the position shown in the FIG. 11B as the spindle 41 rotates. Nonetheless, as a result of the pushing movement during the process the teeth T of the key K being inserted into the spindle 41, part of the barrier plate 44 extends outside the spindle 41 into the second groove 252 of the lock casing 2 (as shown in FIG. 10). The rotating range of the spindle 41 is restricted by the opposite walls of the second groove 252 to be the range covered by the second groove 252 (refer to FIG. 1 and FIG. 2). In other words, the key K is operated to rotate in the spindle 41 of the key lock core 4 within a certain range of angle.

Figure 12A:
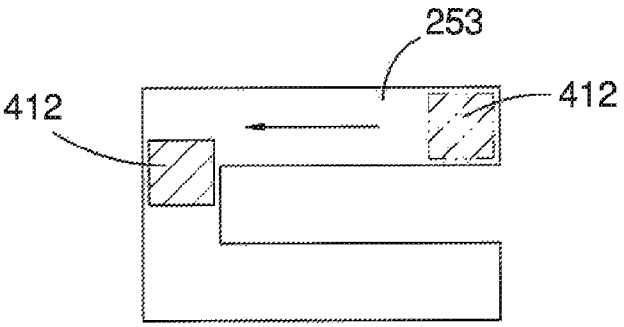
FIG. 12A is a moving position schematic diagram illustrating the movement of the bump of the spindle in the channel in the FIG. 12.
Figure 12:
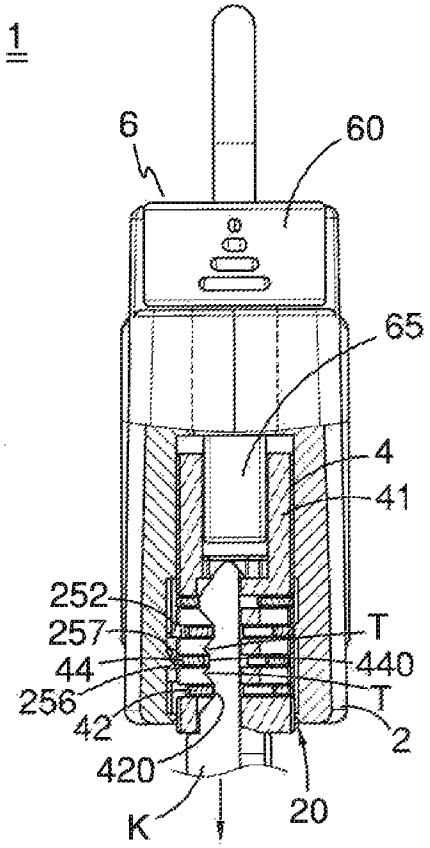
FIG. 12 is a partial cross-section diagram illustrating the process of the pulling from the spindle according to the preferred embodiment.
Figure 13A:
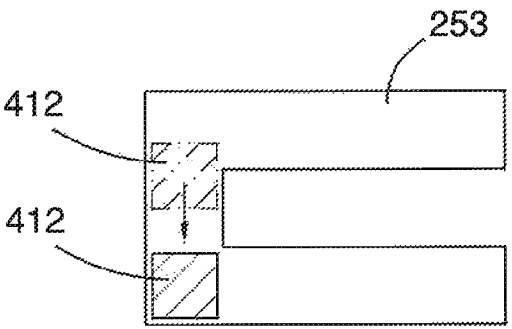
FIG. 13A is a moving position schematic diagram illustrating the movement of the bump of the spindle in the channel in the FIG. 13.
Figure 13:
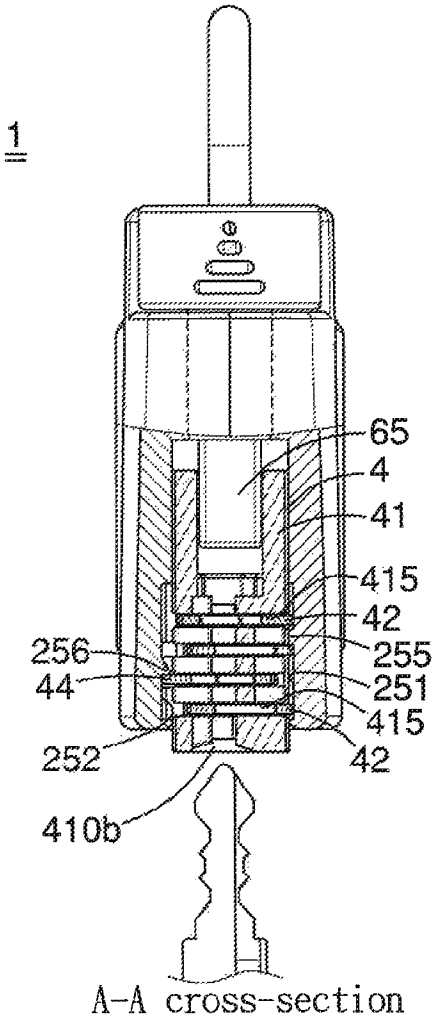
FIG. 13 is partial cross-section diagram illustrating the key is completely pulled from the spindle according to the preferred embodiment.

When the key lock core 4 is operated by the key K to rotate towards the other direction, the spindle 41 rotates counter clockwise along with the key K and drives the button component 6 to move to the restrict position which transfers the padlock 1 to the locked status. Next, as shown in FIG. 12, when the key K is pulled out of the key lock core 4, the teeth T slightly hook the strips 42 and the pore wall of the through holes 420, 440 of the strips 42 and the barrier plate 44, and drive the spindle 41 to move towards the direction of the pore 20. As shown in FIG. 13, when the key K is completely pulled out of the key hole 410*b* of the spindle 41, the bottom of the spindle 41 extends outside the lock casing 2 from the pore 20. In details, as the key K is pulled from the key lock core 4, it drives the spindle 41 of the key lock core 4 to move outward, the barrier plate 44 which extends outside the spindle 41 and into the second groove 252 moves from the upper side to the bottom side of the second rib 256 along the incline 257 of the second rib 256 (because the barrier plate 44 is not pushed by the spring, and easily moves along the incline 257). At the time, the bump 412 of the spindle 41 moves down along the channel 253 of the lock casing 2 (FIG. 13A). Because the bump 412 of the spindle 41 only moves within the channel 253 of the lock casing 2, the spindle 41 of the key lock core 4 is restricted by the channel 253 as the spindle 41 of the key lock core is driven by the key K to move to the indicating position (13A), and is not able to move further towards outside the pore 20 of the lock casing 2. Such design can avoid the spindle 41 from being completely pulled from the pore 20 of the lock casing 2. On the other hand, when the key K is almost completely pulled from the key lock core 4, the upfront teeth T push the barrier plate 44 to extend into the second groove 252 to the bottom side of the second rib 256 as shown in FIG. 13. As the key K is completely pulled from the spindle 41 of the key lock core 4, the strips 42 is ejected from the corresponding horizontal pathway 415 with the elastic force released by the corresponding spring 43 (FIG. 1 and FIG. 2), and part of the edge extends into the first groove 251. At the time, two of the strips 42 block the upper side and the bottom side of the first rib 255, such that the spindle 41 of the key lock core 4 stays at the indicating position and is not able to pull out or push in. Similarly, the barrier plate 44 is blocked at the bottom side of the second rib 256, the spindle 41 of the key lock core 4 stays at the indicating position and cannot be pushed back to the original position.

Figure 14A:
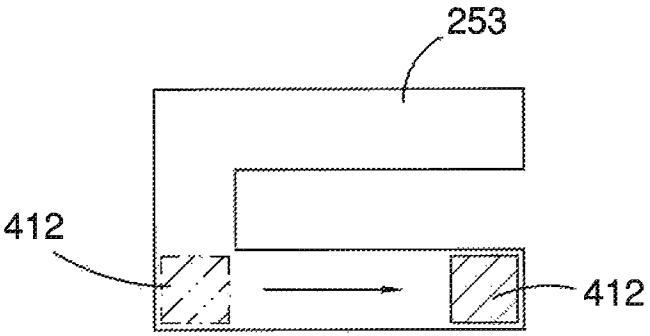
FIG. 14A is a moving position schematic diagram illustrating the movement of the bump of the spindle in the channel in the FIG. 14.
Figure 14:
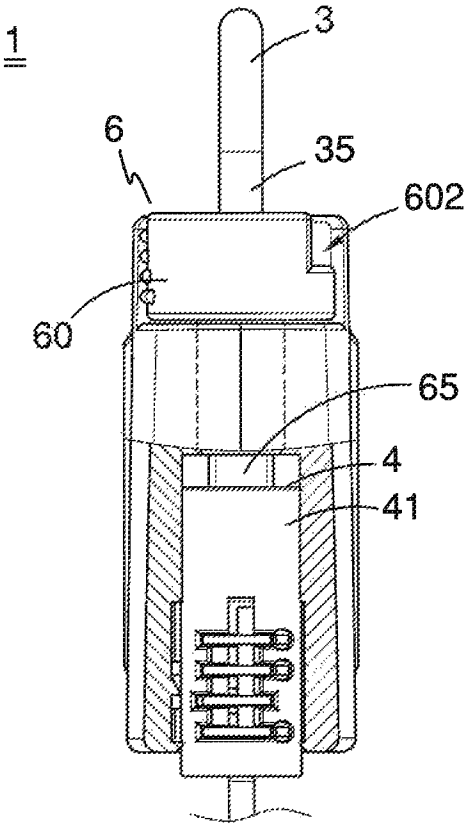
FIG. 14 is a partial cross-section diagram illustrating the spindle changed to the unlocked status at an indicating position according to the preferred embodiment.

Also, as shown in FIG. 14, even when spindle 41 of the key lock core is located at the indicating position, the key K can be used to operate the spindle 41 for driving the button component 6 to move to the release position for releasing free segment 35 of the shackle 3 and performing unlocking or locking the padlock 1. FIG. 14A moving position schematic diagram illustrates the movement of the bump 412 of the spindle 41 in the channel 253 of the lock casing 2 when the spindle 41 is located in the indicating position.

In summary, the padlock 1 of the present invention has the key lock core 4 with a spindle 41 moving from the original position (the spindle 41 is located in the lock casing 2 completely) to the indicating position (the spindle 41 partly extends outside the lock casing 2) in respond to the operation of the key K, and stays at the indicating position after blocked by the strips 42 and the barrier plate 44, which allow the user to detect if the padlock 1 has been operated by the key K.

In addition, refer to the FIG. 10, when the key K is inserted into the spindle 41, because the strips 42 and barrier plates 44 in the spindle 41 are pushed by the corresponding teeth T of the key K and retract into pathways corresponding to the spindle 41. Consequently, even if the key K is pulled out instead of rotated in the spindle 41, the spindle 41 also moves from the original position to the indicating position.

Figure 15A:
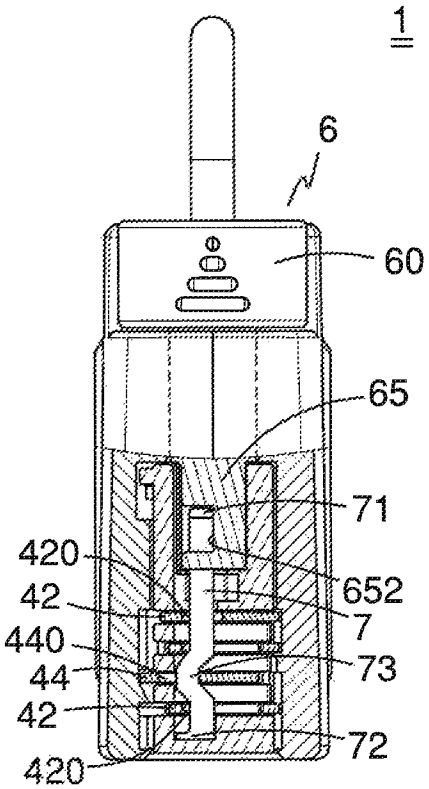
FIG. 15A illustrates a partial cross-section schematic diagram from the other direction of the FIG. 15.
Figure 15:
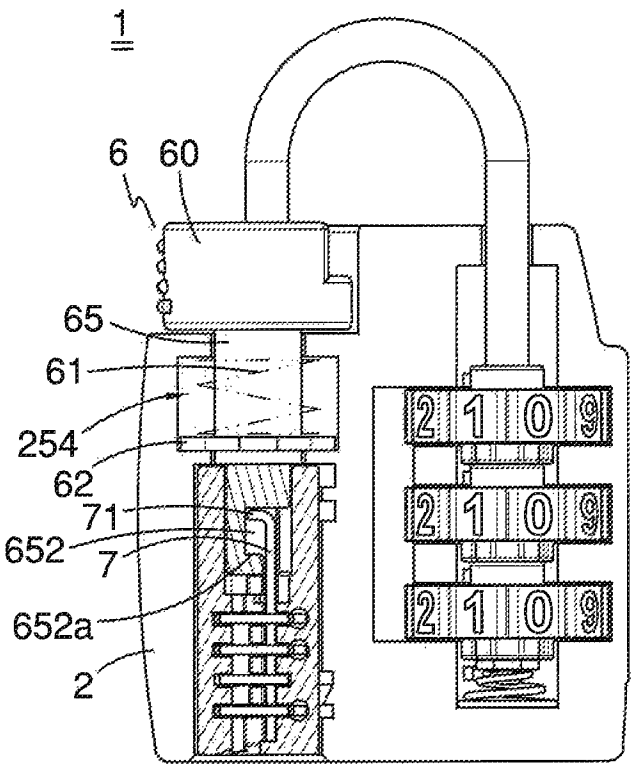
FIG. 15 is a partial cross-section schematic diagram according to the preferred embodiment.

In addition, FIG. 10 and FIG. 13 illustrate that when the spindle 41 is at the original position or the indicating position, the extending component 65 is located in the vertical pathway 410 of the spindle 41, and the extending component 65 and the receiving opening 410*a* are engaged with each other. Accordingly, when the spindle 41 is at the original position, the spindle 41 is rotated by the key K for driving the head component 60 of the button component 6 to rotate in order to perform locking or unlocking. When the spindle 41 is at the indicating position, the spindle 41 is rotated by the key K for driving the head component 60 of the button component 6 to rotate in order to perform locking or unlocking. Refer to FIG. 1, FIG. 2 and FIG. 15, the two ends of the connecting component 7 have a first hook 71 and a second hook 72, and a push component 73 in the middle of the connecting component 7. The connecting component 7 is disposed through the vertical pathway 410 of the spindle 41, and disposed through holes 420, 440 of the strips 42 and the barrier plate 44 in the spindle 41. The first hook 71 connects to the extending component 65 of the button component 6. The first hook 71 is disposed in a slot 652 at the end of the extending component 65 and is at a distance from the bottom edge of the slot 652. It should be noted that the lower segment of the connecting component 7 is located in the strips 42 and through holes 420, 440 of the barrier plate 44. However, the position of the lower segment of the connecting component 7 is next to the position of the key hole 410*b*. When the key K inserts into the key hole 410*b* and extends into through holes 420, 440 of the strips 42 and the barrier plate 44, the key K and the connecting component 7 are disposed side by side. In short, a pathway is formed by the strips 42 and through holes 420, 440 of the barrier plate 44 and a part of the pathway is used for receiving the lower segment of the connecting component 7 and the other part is used for receiving the key K.

Refer to FIG. 1, FIG. 2 and FIG. 15, the button component 6 further comprises a spring 61 and a barrier component 62. The spring 61 is disposed outside the extending component 65, and located in a third groove 254 in the lock casing 2. The barrier component 62 is embedded in a ring groove 651 on the exterior wall of the extending component 65, and located in the bottom of the spring 61. Accordingly, the spring 61 is compressed between the upper wall 254*a* of the third groove 254 and the barrier component 62.

Figure 16A:
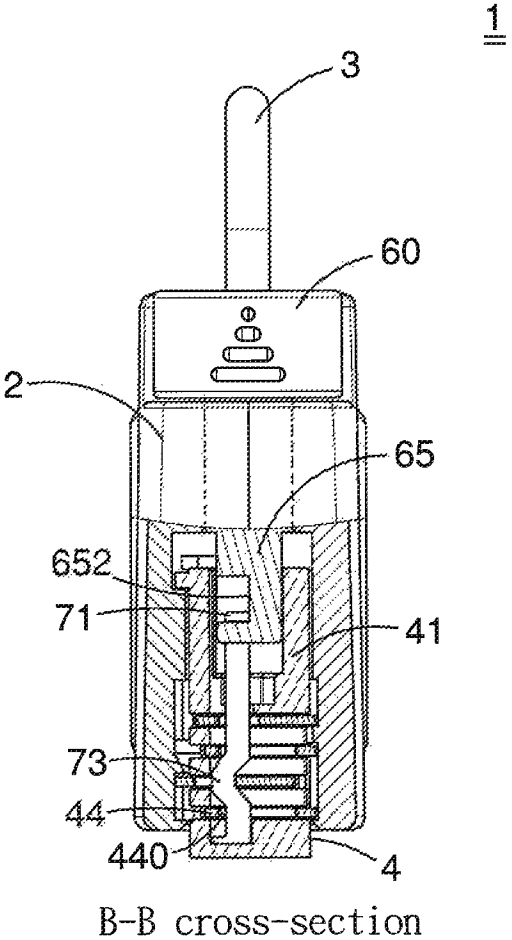
FIG. 16A illustrates a partial cross-section schematic diagram from the other direction of the FIG. 16.
Figure 16:
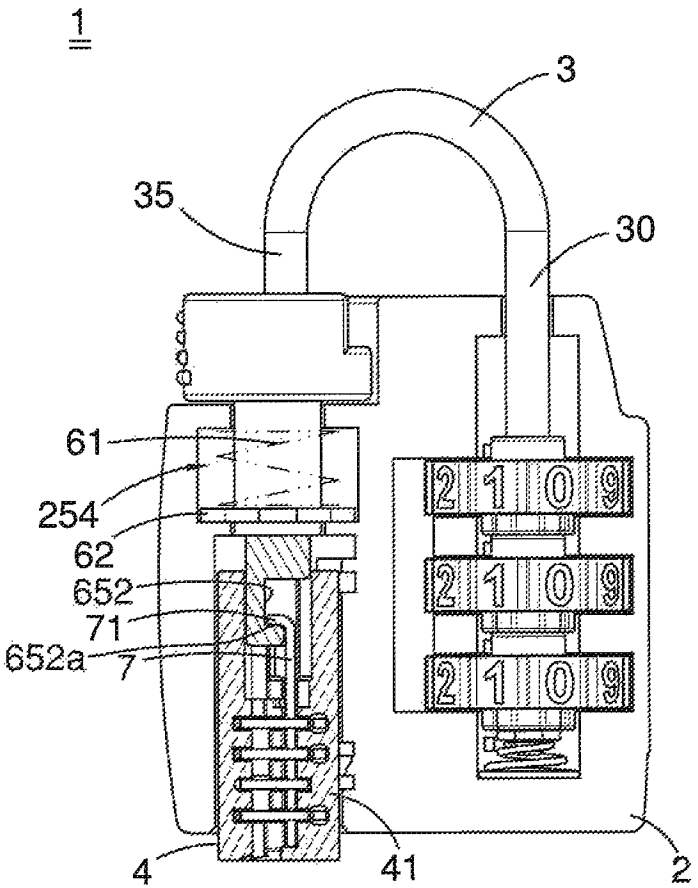
FIG. 16 is a partial cross-section schematic diagram according to the preferred embodiment illustrating the spindle is located on the indicating position.

As shown in the FIG. 16, when the spindle 41 is located at the indicating position, the first hook 71 of the connecting component 7 hooks the bottom edge 652*a* of the slot 652. As shown in the FIG. 16, the push component 73 is located in the through hole 440 of the barrier plate 44.

Figure 17A:
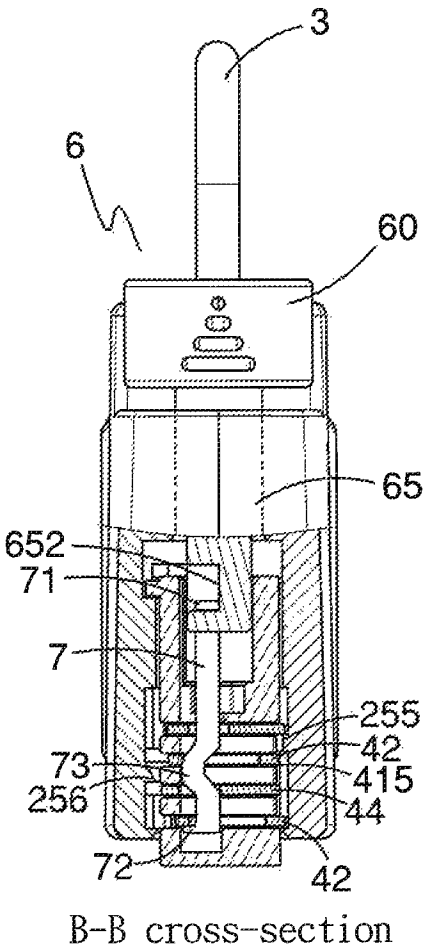
FIG. 17A illustrates a partial cross-section schematic diagram from the other direction of the FIG. 16.
Figure 17:
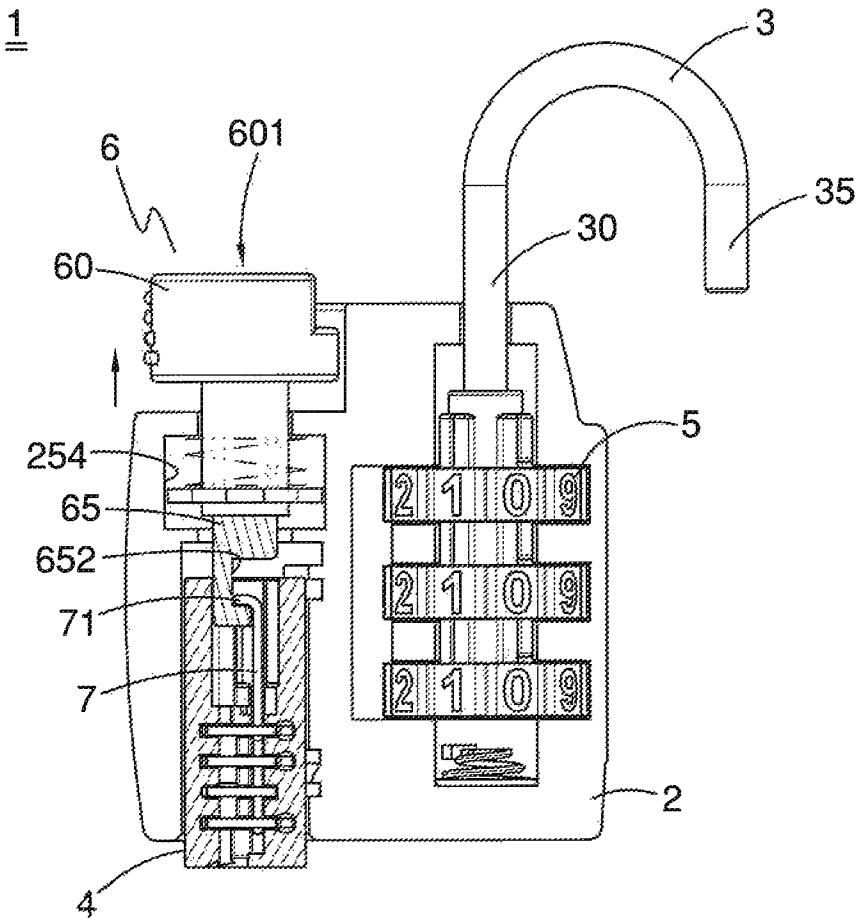
FIG. 17 is a partial cross-section schematic diagram illustrating the spindle is restored by a button component according to the preferred embodiment.
Figure 18A:
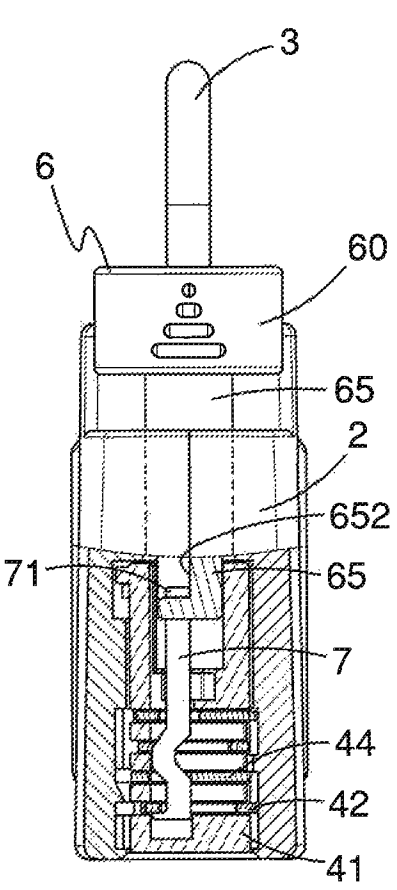
FIG. 18A illustrates a partial cross-section schematic diagram from the other direction of the FIG. 18.
Figure 18:
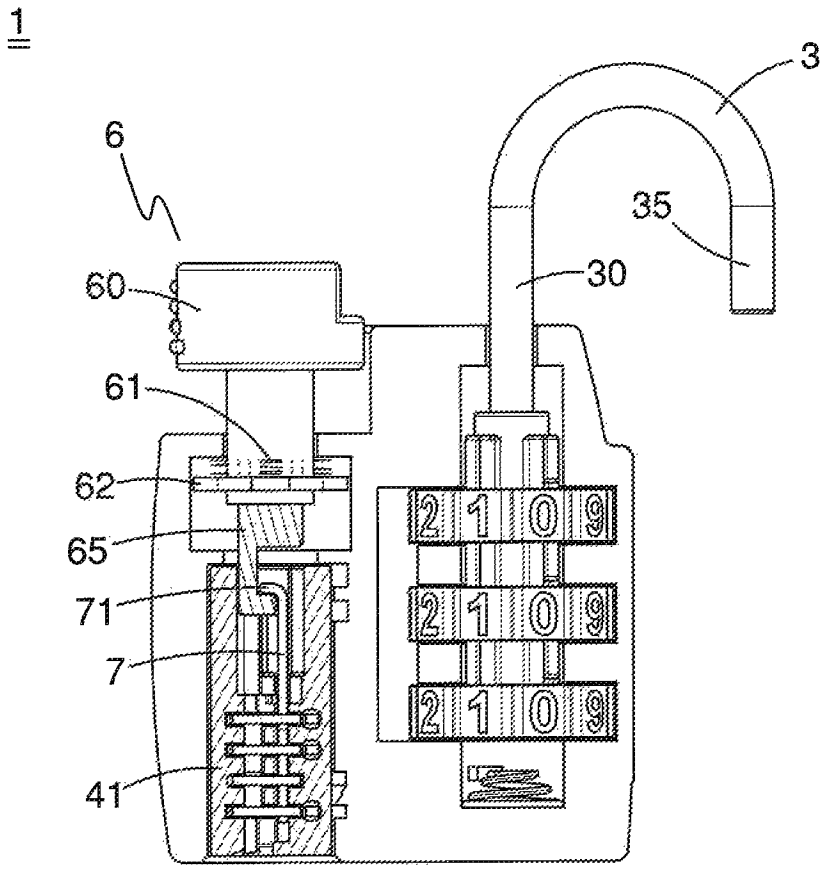
FIG. 18 is a partial cross-section schematic diagram according to a preferred embodiment illustrating the spindle is restored by the button component to an original position.

FIG. 17 and FIG. 18 are diagrams illustrating the process the spindle 41 moves from the indicating position (partly extends outside the lock casing 2) to the original position (located in the lock casing 2) via the button component 6. First, the free segment 35 of the shackle 3 moves away from the receiving channel 601 of the button component 6. For example: the number lock 5 is unlocked to release the root segment 30 of the shackle 3 and lift the root segment 30. Consequently, the free segment 35 moves away from the receiving channel 601 and rotates as shown in the FIG. 17. Next, the head component 60 of the button component 6 is lifted to drive both the extending component 65 and the connecting component 7 hooked in the bottom edge of the slot 652 to move upwards. As shown in the FIG. 17A, as the connecting component 7 moves upwards, the push component 73 pushes respectively the strip 42 hooked at the bottom side of the first rib 255, and the barrier plate 44 hooked at the lower part of the second rib 256. Consequently, the strip 42 and the barrier plate 44 respectively retract to the horizontal pathway 415 corresponding to the spindle 41. Thus, the status of the spindle 41 of the key lock core 4 changes from hooked by the first rib 255 and the second rib 256 in the lock casing 2 to the status able to move. Lastly, the second hook 72 of the connecting component 7 hooks the strip 42 located at the lowest side for driving the spindle 41 to move upwards so as to move the spindle 41 to the original position located in the lock casing 2.

In addition, as shown in the FIG. 18, as the button component 6 is lifted, the spring 61 is compressed by the barrier component 62 to generate elastic force. Therefore, when the force to life the button component 6 disappears, the barrier component 62 is impacted by the elastic force released by the spring 61 to drive the extending component 65 and the head component 60 to move to the original position, as shown in the FIG. 15.

It should be pointed out that, the button component of the embodiment mentioned above is configured to link-up the key lock core to move to the original position by means of lifting upwards. Nonetheless, the button component in fact can be configured to move along vertical direction or move along horizontal direction or rotate for linking-up the key lock core to move to the original position.

According to the above mentioned description, as a result that the number lock core is at an unlocked status (i.e. a correct set of password is dialed), the shackle of the padlock according to the present invention is lifted upwards to move away from the position of the button component. Then, the button component link-up the key lock core located at the indicating position to move from the indicating position to the original position for accomplishing the purpose of resetting the key lock core. In addition to providing locking and unlocking functions, the key lock core is used for providing indicating function as a reminder that the padlock of the invention has been unlocked or operated. Hence, the key lock core is substantially an indicating device, which means the button component of the present invention is used for link-up an indicating device for driving the indicating device to move from an indicating position to an original position. As a result, the button component of the present invention does not only have the function to lock and unlock, also the function to resetting an indicating device.

The invention claimed is:

1. A lock, comprising:

a lock casing;

a shackle comprising a root segment disposed in the lock casing, and a free segment extending from the root segment;

a key lock core, having a spindle, the spindle having a key hole for receiving a matching key, wherein the spindle is able to move from an original position where the spindle is completely located within the lock casing to an indicating position where the spindle partly extends outside of the lock casing, and no matter whether the spindle is situated in the original position or in the indicating position, the spindle is able to be rotated by the key; and a button component disposed on the lock casing and configured to rotate with the spindle of the key lock core between a locking position where the free segment of the shackle is blocked in the button component from rotation about the root segment, and an unlocking position where the free segment is released from the button component for rotation about the root segment.

2. The lock of claim 1, wherein the spindle moves from the original position to the indicating position upon the spindle being operated by the key.

3. The lock of claim 2, wherein the spindle moves from the original position to the indicating position upon the key being pulled out of the key hole.

4. A lock, comprising:

a lock casing;

a shackle, comprising a root segment which is disposed in the lock casing and rotatable and a free segment which extends from the root segment;

a button component, being movable between a locking position where the free segment of the shackle is blocked in the button component from rotation about the root segment, and an unlocking position where the free segment of the shackle is released from the button component for rotation; and a key lock core, disposed in the lock casing and having a spindle; wherein the spindle has a key hole for receiving a matching key and is able to move from an original position where the spindle is completely located within the lock casing to an indicating position where the spindle partly extends outside of the lock casing with respect to the button component;

wherein the spindle is able to be moved from the indicating position to the original position by the button component.

5. The lock of claim 4, wherein the spindle moves from the original position to the indicating position upon the spindle being operated by the key.

6. The lock of claim 4, wherein the spindle moves from the original position to the indicating position upon the key being pulled out of the key hole.

7. The lock of claim 4, comprising a connecting component, wherein the connecting component has one end located in a slot of the button component and the other end connecting to the key lock core, wherein when the spindle is at the original position, the end of the connecting component is at a distance from a bottom edge of the slot so that the spindle is able to stay at the original position when the button component is pulled; when the spindle is at the indicating position, the end of the connecting component is in contact with the bottom edge of the slot so that the spindle is driven by the button component to move from the indicating position to the original position when the button component is pulled.

8. A lock, having a shackle, a button component for controlling rotation of the shackle, and an indicating device moving between an original position and an indicating position, wherein the button component is configured to control rotation of a free segment of the shackle about a root segment of the shackle; the indicating device is able to move relative to the button component from an original position where the indicating device is completely located within the lock casing to an indicating position where the indicating device partly extends outside of the lock casing; and the indicating device is able to be moved from the indicating position back to the original position by the button component.

9. The lock of claim 8, wherein the indicating device is able to linearly move from the original position to the indicating position along a first direction, the button component is able to linearly move along a second direction and drive the indicating device moving from the indicating position to the original position synchronously, wherein the first direction opposites the second direction.

10. The lock of claim 8, wherein the indicating device is a spindle and the spindle has a key hole for receiving a key.

* * * * *